US007286150B2

(12) United States Patent
Hann

(10) Patent No.: US 7,286,150 B2
(45) Date of Patent: Oct. 23, 2007

(54) THERMAL TRANSFER PRINTING

(75) Inventor: Richard Anthony Hann, Ipswich (GB)

(73) Assignee: Imperial Chemical Industries Inc., London (GB)

( * ) Notice: Subject to any disclaimer, the term of this patent is extended or adjusted under 35 U.S.C. 154(b) by 316 days.

(21) Appl. No.: 10/508,323

(22) PCT Filed: Mar. 21, 2003

(86) PCT No.: PCT/GB03/01193

§ 371 (c)(1),
(2), (4) Date: Sep. 20, 2004

(87) PCT Pub. No.: WO03/080361

PCT Pub. Date: Oct. 2, 2003

(65) Prior Publication Data

US 2005/0128279 A1 Jun. 16, 2005

(30) Foreign Application Priority Data

Mar. 21, 2002 (GB) ..... 0206677.7

(51) Int. Cl.
*B41J 2/325* (2006.01)

(52) U.S. Cl. ..... 347/172

(58) Field of Classification Search ..... 347/171–172, 347/213, 173–176; 400/120.02
See application file for complete search history.

(56) References Cited

U.S. PATENT DOCUMENTS

| | | | | |
|---|---|---|---|---|
| 5,089,350 | A | 2/1992 | Talvalkar et al. | |
| 6,002,416 | A | 12/1999 | Gerber | |
| 6,155,168 | A * | 12/2000 | Sakamoto | 101/171 |
| 6,392,680 | B2 * | 5/2002 | Akada et al. | 347/213 |
| 2003/0035043 | A1 * | 2/2003 | Sugiyama et al. | 347/171 |
| 2003/0156181 | A1 * | 8/2003 | Bouchard et al. | 347/172 |
| 2005/0208237 | A1 | 9/2005 | Narita et al. | 428/32.76 |

FOREIGN PATENT DOCUMENTS

| | | |
|---|---|---|
| EP | 0 641 008 A | 3/1995 |
| EP | 0 982 140 A | 3/2000 |
| JP | 10-315605 | 12/1998 |
| JP | 2000-141863 | 10/2000 |

* cited by examiner

*Primary Examiner*—K. Feggins
(74) *Attorney, Agent, or Firm*—Morgan Lewis & Bockius LLP

(57) ABSTRACT

A method of printing a fluorescent image on a surface of a receiver medium comprises forming on the surface by a thermal dye transfer printing process a first image of a first fluorescent dye; and forming on the first image by a thermal dye transfer printing process a superimposed second image of a second fluorescent dye, the first and second dyes having different emission maxima. The method thus enables production of a non-monochrome fluorescent image (that can be substantially invisible in daylight but that is revealed on irradiation with ultraviolet (UV) light) that can be of substantially better quality than those produced by mass transfer printing processes. The method preferably involves the use of three different fluorescent dyes, for improved colour image quality. The invention also provides thermal transfer media suitable for use in the method and the resulting printed material bearing a fluorescent image.

16 Claims, 1 Drawing Sheet

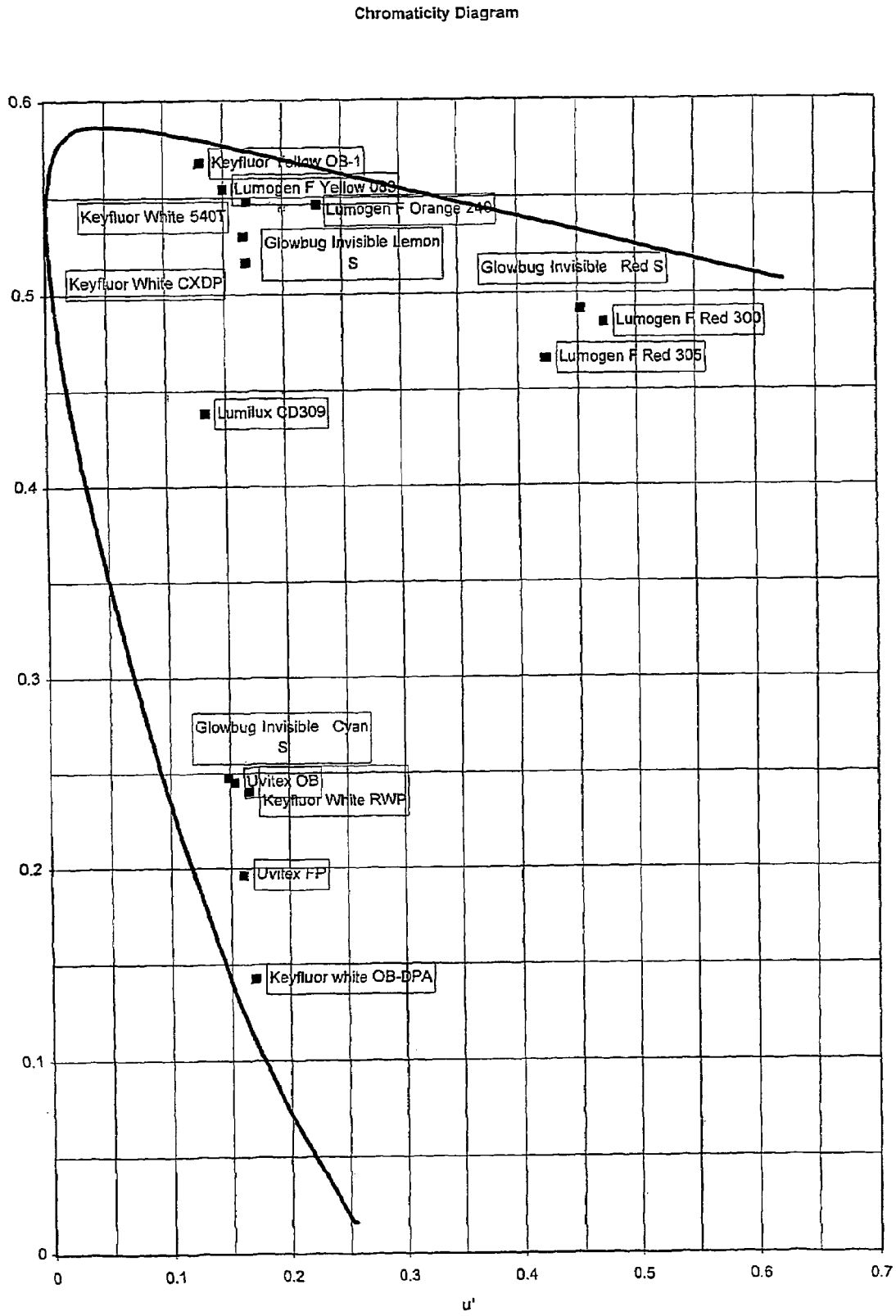
FIGURE I

THERMAL TRANSFER PRINTING

FIELD OF THE INVENTION

This invention relates to thermal transfer printing, and concerns a method of printing, a thermal transfer medium and printed material produced by the method.

BACKGROUND TO THE INVENTION

The process of thermal melt transfer (also known as thermal mass transfer or wax transfer) is well known in the art. In this technology, a dye or a pigment is dispersed in a binder, which has a low melting point. The dispersion is coated as a coloured layer onto an elongate strip or ribbon of a heat-resistant substrate, typically polyethylene terephthalate film, and is used to print onto plain paper or other receiver media. In the printing process, the ribbon is in contact with the receiver medium, while moving through the nip between a thermal head and a roller. Usually, the thermal head extends across the entire width of the ribbon and media, and consists of a line of individually addressable electrical heating elements. The elements are activated so as to transfer the coloured layer from the ribbon to the receiver medium, in order to print, for example, text, a bar code, or even a half-tone image. The nature of the printing process is essentially binary—the heated area of the coloured layer transfers completely, and this is the reason that any images printed can only be half tone, rather than continuous tone as in a photograph.

Multicolour images can be printed by using a ribbon carrying a plurality of similar sets of different coloured layers, each set comprising a panel of the subtractive primary colours (yellow, magenta and cyan) with an optional black panel, with the panels being in the form of discrete stripes extending transverse to the length of the ribbon, and arranged in a repeated sequence along the length of the ribbon. Such images are still subject to the binary nature of the melt transfer process and are coarse in nature.

The process of thermal dye transfer is also well known. The ribbon used is very similar in appearance to the coloured ribbon used in melt transfer, but the composition of the panels is different. Whereas dyes or pigments may be used for melt transfer, pigments cannot be used for dye transfer, as it is essential to use colorants that are capable of dissolving in, and migrating through, the polymers that make up the coatings on the ribbon and on the receiver media. The dyes chosen are typically soluble in organic solvents and are typically coated onto the ribbon in a polymeric binder. The receiver medium normally needs a smooth polymeric surface in order to be in intimate contact with the ribbon during the printing process and to receive the dyes. Only the dyes transfer during printing, and the polymeric binder remains in place on the ribbon.

The printing process is similar to that described above for melt transfer, but because the dye is transferred by a molecular diffusion process, the amount transferred at each point is determined by the amount of heat applied by the thermal head. By varying the amount of heat applied at each point during printing, it is thus possible to achieve a continuous tone image, which is of much higher quality than the half tone images achievable using melt transfer. Indeed, photographic quality images are available by this printing process.

A printer is normally designed to take an electronic image, such as might be displayed on a cathode ray tube (CRT) and to reproduce it faithfully as a printed image. In order to do this, the red, green and blue (RGB) additive colours used must be converted to cyan, magenta and yellow (CMY) subtractive primary colours for printing. This is essentially an inversion process, as cyan absorbs red light, magenta absorbs green light and yellow absorbs blue light.

Fluorescent materials may also be transferred thermally. For example the melt transfer of fluorescent pigments is described in JP59-054598. Fluorescent dyes have also been transferred, for example as described in EP374835A1.

JP2000141863 describes the use of multicoloured mass transfer of fluorescent pigments in order to build up a full colour image onto a security card. Because of the binary nature of the mass transfer process, the quality of such an image is necessarily poor.

SUMMARY OF THE INVENTION

In one aspect, the present invention provides a method of printing a fluorescent image on a surface of a receiver medium, comprising forming on the surface by a thermal dye transfer printing process a first image of a first fluorescent dye; and forming on the first image by a thermal dye transfer printing process a superimposed second image of a second fluorescent dye, the first and second dyes having different emission maxima.

The method thus enables production of a non-monochrome fluorescent image (that can be substantially invisible in daylight but that is revealed on irradiation with ultraviolet (UV) light) that can be of substantially better quality than those produced by mass transfer printing processes.

The method preferably involves the use of three different fluorescent dyes, for improved colour image quality. Thus, the method preferably involves forming on the second image by a thermal dye transfer printing process a superimposed third image of a third fluorescent dye, the third dye having an emission maximum different from that of the first and second dyes. The dyes preferably have the fluorescent colours of red, green and blue (the additive primary colours) for good full colour reproduction.

The dyes are preferably colourless or substantially colourless so the resulting image is invisible or substantially invisible in daylight. However, the dyes produce visible fluorescence (of different colours) when irradiated with UV, rendering the image visible.

In order to carry out printing of a full colour image, the amount of dye of each fluorescent colour transferred should correspond to the amount of red, green or blue in the image at that point. It is therefore generally in the same proportions as the colours shown say on a CRT, and opposite to the proportions used in normal colour printing. Thus, if a ribbon is made up in which the cyan, magenta and yellow panels of a normal ribbon are respectively replaced by red, green and blue fluorescent panels, it is necessary to send a negative image to an unmodified printer. The image is then printed with the correct colours by virtue of a double inversion process. Such inversion can be readily achieved by use of commercially available software.

Because the method uses a dye transfer process, the image produced can exhibit continuous tone and can be of high quality.

The method can be carried out using conventional thermal dye transfer printing techniques and equipment.

The choice of the fluorescent dyes is determined experimentally in order to determine those that transfer readily and produce stable images. It is strongly preferred that the dyes have minimal absorption in the visible region of the spectrum, so that the fluorescent image is invisible in the absence of UV and so that it is not disturbed by unwanted absorption.

In general, dyes without strongly polar groups and having a molecular weight of less than 500 are preferred in order to transfer readily. It is also preferred that the fluorescent molecules should have good stability to heat, so that they are not decomposed during the transfer process and to UV light, so that the resultant image remains stable.

For good colour reproduction, the colours should be red, green and blue. It is preferred to use dyes with emission maxima in the regions of 580 to 700 nm, 480 to 580 nm and 420 to 480 nm, especially 600 to 650, 490 to 560 nm and 440 to 480 nm, and in order to provide a good match to those used in CRT's should ideally have emission maxima at about 610 nm, 550 nm and 470 nm. Fluorescent dyes can also be characterised in terms of u' and v' measurements, which are a way of measuring the colour emitted by the fluorescers on a scale which is approximately linear to the human eye. The measurement is well known in the art, and is often represented as a chromaticity diagram on which the u' values are plotted horizontally and the v' values vertically. The colours of the spectrum form a spectral locus, which encloses the entire gamut of colours visible to the human eye. We prefer to use fluorescent dyes with colours near the spectral locus in the red, green and blue regions of the spectrum and well away from the white point (which can be taken as u'=0.2 and v'=0.46). While these considerations are difficult to quantify precisely, in general it is preferred to use fluorescent dyes with u', v' colour coordinates within a distance of 0.15, more preferably 0.1, units of the spectral locus in the red, green and blue regions of the spectrum. In addition, in general it is preferred to use fluorescent dyes with u', v' colour coordinate at least 0.1, and more preferably at least 0.15, units from the white point. Many of the dyes listed in the following specifications are suitable for use in the present invention: EP 374,835, EP 373,572, EP 362,640, EP 366,923, EP 356,981, EP 356,982, EP 356,980, EP 446846, EP531578, EP574618. A number of suitable dyes are available commercially and include the following:

| Fluorescent dye | u' | v' | Emission/ nm | Fluor. Colour | Visible Colour | Transfer | Utility |
|---|---|---|---|---|---|---|---|
| Glowbug Invisible Cyan S | 0.149 | 0.248 | 440 | good | good | good | good |
| Glowbug Invisible Lemon S | 0.167 | 0.530 | 540 | fair | good | good | fair |
| Glowbug Invisible Red S | 0.453 | 0.492 | 615 | good | good | fair | good |
| Keyfluor White 540T | 0.170 | 0.548 | 530 | poor | good | good | poor |
| Keyfluor White CXDP | 0.169 | 0.516 | 530 | poor | good | good | poor |
| Keyfluor white OB-DPA | 0.171 | 0.142 | 430 | good | good | fair | fair |
| Keyfluor White RWP | 0.167 | 0.240 | 440 | good | good | good | good |
| Keyfluor Yellow OB-1 | 0.130 | 0.568 | 525 | good | fair | good | good |
| Lumilux Green CD309 OL | 0.132 | 0.438 | 490 | fair | good | fair | good |
| Lumogen F Orange 240 | 0.229 | 0.546 | 540 | poor | poor | good | good |
| Lumogen F Red 300 | 0.473 | 0.485 | 615 | good | poor | good | good |
| Lumogen F Red 305 | 0.424 | 0.466 | 615 | good | poor | good | good |
| Lumogen F Yellow 083 | 0.150 | 0.554 | 540 | fair | fair | good | fair |
| Uvitex FP | 0.162 | 0.197 | 440 | good | good | good | good |
| Uvitex OB | 0.154 | 0.245 | 440 | good | good | good | good |

Glowbug, Keyfluor, Lumilux, Lumogen and Uvitex are Trade Marks, with dyes sold under these names being available from Capricorn Chemicals, Keystone Europe Ltd, Riedel de Haen, BASF AG and Ciba-Geigy Ltd, respectively.

The u' and v' values of these dyes are plotted on accompanying FIG. 1 which is a graph of u' versus v'. The solid line on FIG. 1 is the spectral locus, with red at the top right hand corner and blue at the bottom. As noted above, it is preferred to use dyes with u', v' colour coordinates near the spectral locus and well away from the white point.

We have found that in practice, the exact emission colour is not critical and can be corrected by suitable adjustment of the print conditions. In general, we prefer to use fluorescent dyes with narrow emission bands and high efficiency of conversion of UV to visible light.

The chromaticities of the emissions of the dyes are determined and compared with the ideal values for the display of the electronic image. By carrying out a matrix multiplication operation as described for example in "The Reproduction of Colour" by R. W. G. Hunt, Fifth Edition 1995, Fountain Press, England, page 128, page 767, it is possible to calculate optimal values for correction of the colour.

The choice of the optimal emission wavelength is determined not only by colour perception, but also by the variable sensitivity of the eye to different wavelengths. The eye is most sensitive to wavelengths in the region of 550 nm, and progressively loses sensitivity at longer and shorter wavelengths. For example, a red fluorescent dye with an emission maximum at 700 nm will give the widest possible gamut (range of reproducible colours), but because the eye is very insensitive at this wavelength, it is preferable to use a dye that emits at somewhat shorter wavelengths, thus sacrificing some gamut, but gaining in visual brightness. Similar arguments apply to the blue end of the spectrum, so that it may be convenient to use a blue dye fluorescing at longer wavelengths in order to gain brightness at the expense of gamut. The choice of the green fluorescent dye depends to some extent on the choice of red and blue, as it is desirable to have a significant colour difference between the green dye and each of the others in order to maintain a large gamut. So, for example, if a red fluorescent dye is chosen which has an emission maximum at the short wavelength end of the desired range (580 nm), then it is desirable to choose a green fluorescent dye which is also towards the shorter end of the desired range.

By use of appropriate dyes in appropriate concentrations on thermal transfer media (as determined by experiment) it is possible to achieve very good full colour fluorescent images.

By appropriately regulating the amount of heat applied during printing of each different dye (again as determined by experiment) the final image may be further optimised.

For further optimisation of the printed image, it is necessary to correct for defects in the printing process itself. The phenomenon of "clawback" is well known in thermal dye transfer (see, for example, U.S. Pat. No. 5,510,313). Clawback occurs when the same region of a receiver medium is printed with two or more colours. The first colour is printed as normal, but when the second colour is printed on top, some of the first colour can migrate backwards into the region of the second colour. There is thus a net loss of the first colour from the region where the two colours overlap. In the normal printing of coloured dyes, the effect can be beneficial (see U.S. Pat. No. 5,510,310), but we have found that clawback is usually detrimental when fluorescent colours are transferred.

We have found that we can compensate for the unwanted removal of fluorescent dyes by applying a digital mask to the image. Accordingly, therefore, in regions where, for example, red is overprinted with green, the red image is adjusted so that more of the fluorescent red dye is printed. The extra red printed in the overlapping regions just compensates for the amount removed during the green overprinting. As the amount of the first colour which is removed by the second colour is linearly dependent on the intensity of the second colour, the mask that should be applied is also linear.

The stability of dyes to visible and UV radiation is normally termed lightfastness. This is a property which can be very important for a few applications, but much less important in others. We have found that some of the fluorescent dyes that give the brightest coloured images have relatively poor lightfastness, and other dyes with much better lightfastness that give less bright colours. Those skilled in the art will be able to select the fluorescent dyes that represent the compromise between lightfastness and colour that best suits the particular application. They will also be able to recognise the appearance of a fluorescent dye that combines all the desiderata.

It is not necessary to print the fluorescent colours in the order red, green, blue. With the phenomenon of clawback in mind, it is desirable to print the colour with the strongest fluorescence first, so as to ensure that there is sufficient colour to compensate. It is also desirable to print any colour with unwanted absorption in the visible region of the spectrum first, so that its effects on the other colours is minimised. When a standard dye transfer printer is being used, it is preferred to print in the order blue, green, red (e.g. using a dye ribbon with colour panels in the order blue, green, red), if it desired to print a positive fluorescent image from a stored electronic image.

The receiver medium to be printed can be of any material that is a good receiver for thermal dye transfer, for example a suitable white, transparent or reflective substrate coated with the formulations described in EP409514A. Alternatively, the prints of the present invention may be made directly onto standard PVC transaction cards, which normally have a surface layer of vinyl chloride/vinyl acetate copolymer. In any case, it is preferred that the surface to be printed is substantially free of optical brighteners in order to avoid interference with the desired image.

The receiver medium may also be in the form of a retransfer intermediate sheet, that can be used in a retransfer printing process in known manner, typically to print on articles other than flexible sheet material. A retransfer intermediate sheet typically comprises a supporting substrate having a dye-receptive imageable layer on one side, usually with a backcoat on the other side to promote good transport through the initial printer. Retransfer intermediate sheets are disclosed, e.g, in WO 98/02315. The image-carrying intermediate sheet formed in the first stage of a process is separated from a dye-donor sheet, and in a second transfer stage of the process, is pressed against the article, with its image-containing layer contacting an image-receptive surface of the article. Heat is then applied to effect transfer of the image, usually over the whole area of the image simultaneously. This is commonly carried out in a press shaped to accommodate the article, e.g. as disclosed in WO 02/053380.

Because high concentrations of fluorescent dyes can lead to the phenomenon of quenching, where neighbouring molecules of dye can cause a reduction in the luminous efficiency, it is desirable not to have too high a local concentration of dye in the final image. This is partly controlled by using a suitable concentration of dye in the transfer layer on a thermal transfer medium such as a dye ribbon, but can also be achieved by applying further heat to the print after printing, in order to allow the fluorescent dyes to migrate further into the receptive coating and thus to reduce in overall concentration. Heat treatment may be carried out in a number of ways, for example placing in an oven at 100° C. for 30 s, or preferably using a preferential means of heating the surface. This may be achieved by "printing" with a blank area of ribbon in the thermal printer, or alternatively as a consequence of laminating a protective layer on top of the print. The quenching process is an example of where the presence of one fluorescent dye can affect the emission from another fluorescent colour, and in general, dyes that emit at longer wavelengths are more likely to interfere with dyes emitting at shorter wavelengths. As with the phenomenon of clawback, above, it is possible to compensate for this by suitable electronic masking of the image before printing.

The method of the invention may be used in conjunction with thermal transfer printing of visible dyes, e.g. to produce a full colour image visible in daylight on the surface of the receiver medium (generally not superimposed on the image formed by the fluorescent dyes, but distinct therefrom) and/or in conjunction with mass transfer of colourant material e.g. to produce a monochrome printed area such as a bar code on the surface of the receiver medium (again generally not superimposed on the image formed by the fluorescent dyes). Such additional printing may be performed in conventional manner. All the printing steps may conveniently be carried out using a conventional thermal transfer printer.

The resulting image formed on a suitable receiver medium can be used in a retransfer process in conventional manner, as noted above.

In many applications, it is desirable to have a protective layer laminated on top of the final image. This layer may be applied in known manner by mass transfer of a polymer e.g. from a further panel in a dye, or it may be applied as an additional process. The protective layer is effective against mechanical damage and attack by of plasticisers and other chemical agents. In order to improve the light fastness of a normal dye-based image, it is common to include a UV absorber in the protective layer. However, where it is desired to create a fluorescent image, it is preferred not to incorporate a UV absorber, or at least not one that absorbs the UV wavelengths that are used to excite the image. These wavelengths are commonly greater than 350 nm or longer, depending on the illumination source. An example of a suitable protective material is Vylon GK-640 (Toyobo) (Vylon GK-640 is a Trade Mark) which is a polyester containing propylene glycol as the principal diol component. It may be desirable to cover only the non-fluorescent parts of the image with a UV absorbent protective layer.

In a further aspect, the present invention provides a thermal transfer medium suitable for use in a thermal dye transfer printing process, comprising a substrate bearing on at least part of one surface thereof a first coating comprising a first fluorescent dye dispersed in a binder, and a second coating comprising a second fluorescent dye dispersed in a binder, the first and second fluorescent dyes having different emission maxima.

The thermal transfer medium preferably comprises a third coating comprising a third fluorescent dye dispersed in a binder, the third dye having an emission maximum different from that of the first and second dyes, with the three dyes preferably having the fluorescent colours of red, green and blue.

The substrate may be suitable heat-resistant material such as those known in the art. Suitable substrate materials include films of polyesters, polyamides, polyimides, polycarbonates, polysulphones, polypropylene and cellophane. Biaxially oriented polyester film, particularly polyethylene terephthalate (PET), is currently favoured for its properties of mechanical strength, dimensional stability and heat resistance. The substrate suitably has a thickness in the range 1 to 20 μm, preferably 2 to 10 μm, typically about 6 μm.

The thermal transfer medium preferably includes a subcoat or priming layer between the substrate and ink coating, particularly in the form of a subcoat to enhance adhesion.

The thermal transfer medium desirably includes a heat-resistant backcoat, on the side of the substrate not carrying the ink coating, to resist applied heat in use in known manner.

The binder is usually in the form of a thermoplastic resin, preferably having a Tg in the range 50 to 180° C., selected to impart print durability and clean transfer characteristics. Suitable binder materials are known in the art, e.g. as disclosed in EP 0283025, and include vinyl chloride/vinyl acetate copolymers, polyester resins, polyvinyl chloride resins, acrylic resins, polyamide resins, polyacetal resins and vinyl resins. A mixture of binders may be used. One currently preferred binder is poly(vinylbutyral).

By selecting concentration of dye in each coating appropriately, very good full colour fluorescent images can be obtained, as discussed above. The preferred concentration of dye in each coating is partly chosen so as to give good balance between the different colours. In general, it is advantageous to use lower dye concentrations than is common for visibly absorbing dyes, as the colour of fluorescence is often shifted at higher concentrations. With suitable fluorescent dyes, we could use up to 1:1 by weight with the binder (as in common with dye D2T2), but more often prefer to use 3:1 to 100:1 binder:dye, preferably in the range 10:1 to 50:1.

The dyes are conveniently as discussed above.

The thermal transfer medium is conveniently in the form of a ribbon for use in thermal dye transfer printing, comprising a substrate having on one surface thereof a plurality of repeated sequences of fluorescent dye coats in the form of discrete stripes extending transverse to the length of the ribbon.

Thus in a preferred aspect, the invention provides a thermal transfer medium suitable for use in a thermal dye transfer printed process, comprising an elongate strip of substrate material having on one surface thereof a plurality of similar sets of thermally transferable fluorescent dye coats, each set comprising a respective coat of each dye colour, red, green and blue, dispersed in a binder, each coat being in the form of a discrete stripe extending transverse to the length of the substrate, with the sets arranged in a repeated sequence along the length of the substrate.

Such a preferred elongate ribbon-like strip may otherwise be of generally conventional construction, e.g. as disclosed in WO 00/50248.

The order of the fluorescent dye coats is preferably blue, green, red (for printing in that order) as discussed above.

Each set of the strip may also include a respective coat of each visible dye colour, yellow, magenta and cyan, optionally also a mass transfer colourant layer and possibly also a stripe of overlay material, as discussed above.

The thermal transfer medium is conveniently made by mixing together the coating materials (binder, fluorescent dye and any optional ingredients) and dissolving or dispersing the mixture in a suitable solvent as is well known in the art to give a coating liquid. Suitable solvents include butan-2-one [methyl ethyl ketone (MEK)], propanone, tetrahydrofuran (THF), toluene cyclohexanone etc. The coating liquid is then coated on the substrate and dried in known manner, e.g. by bar coating, blade coating, air knife coating, gravure coating, roll coating, screen coating, fountain coating, rod coating, slide coating, curtain coating, doctor coating. The coating suitably has a thickness in the range 0.1 to 10 μm, preferably 0.5 to 7 μm, typically 1.5 to 5.0 μm.

The invention also includes within its scope receiver material after printing by the method of the invention and bearing a fluorescent image.

The thermal dye transfer printing process may be a dye diffusion thermal transfer printing process.

The invention finds application in a number of different areas, for instance, in cases where the resulting images are not visible unless viewed under UV light, there are many security applications. For example credit cards or identification cards can be printed with an image of the bearer, or some other image, text or design that is useful for identification purposes. Paper-based photographic images intended for eg passport use can be overprinted with an invisible multicolour identification image in order to prevent forgery.

There are also decorative applications. In many public places, such as clubs, bars, etc, UV light is used to create unusual lighting effects. Articles printed using the current invention can be used to good effect in these environments, for example as posters or decorated articles such as T shirts, drinking glasses, mobile telephone cases, or temporary tattoos, etc.

The three-dimensional articles, and most textile materials require to be printed by a retransfer process, for example as described in PCT/GB02/00037 (WO 02/053380).

The invention will be further described, by way of illustration, in the following examples.

In the accompanying drawing, FIG. 1 is a chromaticity diagram for various fluorescent dyes in the form of a graph of u' versus v'.

EXAMPLES

Example 1

Pre-coated biaxially oriented polyester film (KE203E4.5 from Diafoil) of thickness 4.5 μm pre-coated on one side with a priming adhesive layer was coated on the side opposite to the priming layer with a heat-resistant back coat as described in EP703865A. The primed surface of three samples was coated with a solution of 1 g of poly(vinylbutyral) grade BX-1 from Sekisui in 20 g of tetrahydrofuran (THF), containing an amount of dissolved fluorescent dye, as specified below:

Red fluorescent Dye: Glowbug Invisible Red (Capricorn Chemicals) 0.05 g

Green fluorescent dye: Lumogen F Yellow 083 (BASF AG) 0.02 g

Blue fluorescent dye: Uvitex FP (Ciba-Geigy Ltd) 0.05 g

The samples were coated using a Meier bar giving a 12 μm wet weight, giving approximately 0.6 g $m^{-2}$ after evaporation of the solvent for 60 s at 110° C.

These samples were spliced into the ribbon of a Pebble printer made by Evolis (Pebble is a Trade Mark) in place of the cyan, magenta and yellow panels, respectively. Before printing, the image was inverted (using commercially available software), so that a negative image was sent to the printer. This printer is designed to print directly into the surface of an polyvinyl chloride (PVC) transaction card (comprising a PVC core with a coating consisting predominantly of a vinyl chloride/vinyl acetate copolymer (approximately 95:5 weight ratio, respectively)), which was accordingly printed with the negative image using the modified ribbon. When the card was examined carefully under normal illumination, only a faint coloration could be seen over part of the image. At a glance, the card appeared to be unprinted. However, when it was illuminated with long wavelength (366 nm) UV from a mercury discharge lamp, a clear, full coloured image became apparent. This image, however, had a yellow-green cast.

Example 2

The same dyes were applied in the same way as in Example 1, but the proportions used were changed in order to obtain a more balanced image:

Red fluorescent Dye: Glowbug Invisible Red (Capricorn Chemicals) 0.1 g

Green fluorescent dye: Lumogen F Yellow 083 (BASF AG) 0.01 g

Blue fluorescent dye: Uvitex FP (Ciba-Geigy Ltd) 0.1 g

The coatings were made and the image was printed in the same way as in Example 1. This time, the image printed was not only clear and bright, but also showed good overall colour reproduction.

Example 3

A different green fluorescent dye was used, with the dyes being as follows:

Red fluorescent Dye: Glowbug Invisible Red (Capricorn Chemicals) 0.1 g

Green fluorescent dye: Keyfluor Yellow OB-1 (Keystone Europe Ltd) 0.025 g

Blue fluorescent dye: Uvitex FP (Ciba-Geigy Ltd) 0.1 g

The coatings were made and the image was printed in the same way as in Example 1. This time, the image printed was not only clear and bright, but also showed good overall colour reproduction, with slightly too much contribution from the green. The printed image was even more difficult to detect without the use of UV light.

Example 4

A different blue fluorescent dye was used, with the dyes being as follows:

Red fluorescent Dye: Glowbug Invisible Red (Capricorn Chemicals) 0.1 g

Green fluorescent dye: Keyfluor Yellow OB-1 (Keystone Europe Ltd) 0.025 g

Blue fluorescent dye: Keyfluor White RWP (Keystone Europe Ltd) 0.1 g

The coatings were made and the image was printed in the same way as in Example 1. The image was very similar to that of Example 3. The printed image remained difficult to detect without the use of UV light.

Example 5

The concentration of green dye was reduced compared with Example 4 in order to further improve the colour balance:

Red fluorescent Dye: Glowbug Invisible Red (Capricorn Chemicals) 0.1 g

Green fluorescent dye: Keyfluor Yellow OB-1 keystone Europe Ltd) 0.02 g

Blue fluorescent dye: Keyfluor White RWP Keystone Europe Ltd) 0.1 g

The coatings were made and the image was printed in the same way as in Example 1. The image was very similar to that of Example 4. The printed image remained difficult to detect without the use of UV light.

Example 6

An alternative blue fluorescent dye was used, with the dyes being as follows:

Red fluorescent Dye: Glowbug Invisible Red (Capricorn Chemicals) 0.1 g

Green fluorescent dye: Keyfluor Yellow OB-1 (Keystone Europe Ltd) 0.02 g

Blue fluorescent dye: Uvitex FP (Ciba-Geigy Ltd) 0.1 g

The coatings were made and the image was printed in the same way as in Example 1. The image was very similar to that of Example 5, but with further improved colour balance, skin tones appearing very realistic. The printed image remained difficult to detect without the use of UV light.

Example 7

As the previous examples were found to have relatively poor light fastness, a new formulation was devised, in which the red and blue dyes were replaced.

Red fluorescent dye: Lumogen Red F300 (BASF) 0.05 g

Green fluorescent dye: Keyfluor Yellow OB-1 (Keystone Europe Ltd) 0.025 g

Blue fluorescent dye: Glowbug Invisible Cyan S (Capricorn Chemicals) 0.3 g

The images were found to be very bright and lifelike when illuminated with UV, with only a faint trace of colour in the visible. The light fastness was found to be significantly greater than that of the previous samples.

Example 8

A full-colour fluorescent print was prepared as in Example 7, and then overprinted with a pattern using conventional dyes. In order to minimise absorption of the incident UV and the emitted fluorescence, very pale shades were chosen for the pattern. When the card was illuminated with UV, the fluorescent image was clearly visible through the overprinted pattern, but it was almost invisible under normal illumination.

Example 9

The pattern of Example 8 was printed onto a card using conventional dyes, and then overprinted using fluorescent dyes according to example 7. The fluorescent image was again easily visible under UV, but its presence was easily visible under normal illumination. We believe that this is due to the phenomenon of clawback discussed earlier, and the loss of conventional dye into the fluorescent ribbon when the latter is printed.

Example 10

In order to obtain the highest lightfastness, the following formulation was devised:

Red fluorescent dye: Lumogen Red F300 (BASF) 0.05 g

Green fluorescent dye: Lumilux Green CD309 OL (Riedel de Haen) 0.08 g

Blue fluorescent dye: Glowbug Invisible Cyan S (Capricorn Chemicals) 0.2 g

When illuminated with a UV light a full colour image appeared. The colour gamut from this was found to be lower than when using the Keyfluor Yellow as the green fluorescer, but the light fastness was found to be excellent.

Example 11

The coated films of Example 7 were arranged in a ribbon suitable for use in an Olympus P330 NE printer (P330 NE is a trademark of Olympus Ltd) and an image was printed onto a retransfer intermediate sheet of VP retransfer paper from ICI Imagedata. The retransfer paper comprises a 128 gsm paper core laminated on both sides with a 35 microns thick commercial pearl film such as Toyopearl SS (Toyopearl SS is a Trade Mark). The upper layer of the substrate is coated with a filled whitening layer upon which the receiver layer is coated. The image was placed in contact with a mobile telephone back coated with a receptive coating and the image transferred to the casing of a mobile telephone using the apparatus described in WO 02/053380. The transferred image was almost invisible in normal lighting, but gave a bright and clear full colour luminous image when viewed under UV illumination.

The invention claimed is:

1. A method of printing a fluorescent image on a surface of a receiver medium, comprising forming on the surface by a thermal dye transfer printing process a first image of a first fluorescent dye; forming on the first image by a thermal dye transfer printing process a superimposed second image of a second fluorescent dye; and forming on the second image by a thermal dye transfer printing process a superimposed third image of a third fluorescent dye, wherein the dyes have emission maxima in the ranges 580 to 700 nm, 480 to 580 nm and 420 to 480 nm.

2. A method according to claim 1, wherein the first dye is blue, the second dye is green and the third dye is red.

3. A method according to claim 1, wherein the dyes have emission maxima in the ranges 600 to 650 nm, 490 to 560 nm and 440 to 480 nm.

4. A method according to claim 1, further comprising applying further heat to the image after printing.

5. A method according to claim 1, in conjunction with thermal transfer printing of visible dyes on the surface of the receiver medium and/or in conjunction with mass transfer of colourant material on the surface of the receiver medium.

6. A method according to claim 1, further comprising forming protective layer on top of the final image.

7. Receiver material after printing by the method of claim 1.

8. A method according to claim 1, of printing a fluorescent image on a surface of a receiver medium, comprising forming on the surface by a thermal dye transfer printing process a first image of a first fluorescent dye; and forming on the first image by a thermal dye transfer printing process a superimposed second image of a second fluorescent dye, the first and second dyes having different emission maxima wherein the dyes have u', v' colour coordinates within a distance of 0.15 units of the spectral locus in the red, green and blue regions of the spectrum.

9. A method according to claim 1, of printing a fluorescent image on a surface of a receiver medium, comprising forming on the surface by a thermal dye transfer printing process a first image of a first fluorescent dye; and forming on the first image by a thermal dye transfer printing process a superimposed second image of a second fluorescent dye, the first and second dyes having different emission maxima wherein the receiver medium is a retransfer intermediate sheet, and the image formed thereon is transferred onto an image-receiving surface of an article in a second, transfer stage.

10. An article after retransfer printing by the method of claim 9.

11. A thermal transfer medium suitable for use in a thermal dye transfer printing process, comprising a substrate bearing on at least part of one surface thereof a first coating comprising a first fluorescent dye dispersed in a binder, a second coating comprising a second fluorescent dye dispersed in a binder, and a third coating comprising a third fluorescent dye dispersed in a binder, wherein the dyes have emission maxima in the ranges 580 to 700 nm, 480 to 580 nm and 420 to 480 nm.

12. A thermal transfer medium suitable for use in a thermal dye transfer printing process, comprising an elongate strip of substrate material having on one surface thereof a plurality of similar sets of thermally transferable fluorescent dye coats, each set comprising a respective coat of each dye colour, red, green and blue, dispersed in a binder, each coat being in the form of a discrete stripe extending transverse to the length of the substrate, with the sets arranged in a repeated sequence along the length of the substrate, wherein the dyes have emission maxima in the ranges 580 to 700 nm, 480 to 580 nm and 420 to 480 nm.

13. A thermal transfer medium according to claim 12, wherein the order of the fluorescent dye coats is blue, green, red.

14. A thermal transfer medium according to claim 12 or 13, wherein each set of the strip includes a respective coat of each visible dye colour, yellow, magenta and cyan, optionally also a mass transfer colourant layer and optionally also a stripe of overlay material.

15. A thermal transfer medium according to claim 12 or 13, wherein the dyes have emission maxima in the ranges 600 to 650 nm, 490 to 560 nm and 440 to 480 nm.

16. A thermal transfer medium suitable for use in a thermal dye transfer printing process, comprising a substrate bearing on at least part of one surface thereof a first coating comprising a first fluorescent dye dispersed in a binder, and a second coating comprising a second fluorescent dye dispersed in a binder, the first and second fluorescent dyes having different emission maxima wherein for each coating the weight ratio of binder:dye is in the range 3:1 to 100:1.

* * * * *

UNITED STATES PATENT AND TRADEMARK OFFICE

CERTIFICATE OF CORRECTION

PATENT NO. : 7,286,150 B2
APPLICATION NO. : 10/508323
DATED : October 23, 2007
INVENTOR(S) : Richard Anthony Hann It is certified that error appears in the above-identified patent and that said Letters Patent is hereby corrected as shown below:

On the Title Page:
(73) Assignee:, change the name to Imperial Chemical Industries PLC Signed and Sealed this Twenty-third Day of December, 2008

JON W. DUDAS
*Director of the United States Patent and Trademark Office*